US008272192B2

(12) United States Patent
Vadlja et al.

(10) Patent No.: US 8,272,192 B2
(45) Date of Patent: Sep. 25, 2012

(54) SPRING-ROLL-PACK OPENER

(75) Inventors: Stjepan Vadlja, Cakovec (HR); Ben Cuthbert, Clitheroe (GB); Josip Maric, Cakovec (HR); Stanislav Nemec, Ludbreg (HR); Matija Glozinic, Ludbreg (HR); Josip Gecic, Koprivnica (HR)

(73) Assignee: L & P Property Management Company, South Gate, CA (US)

( * ) Notice: Subject to any disclaimer, the term of this patent is extended or adjusted under 35 U.S.C. 154(b) by 410 days.

(21) Appl. No.: 12/610,809

(22) Filed: Nov. 2, 2009

(65) Prior Publication Data

US 2011/0099947 A1 May 5, 2011

(51) Int. Cl.
*B65B 69/00* (2006.01)

(52) U.S. Cl. ..... 53/381.1; 53/389.4; 53/492; 53/114; 53/116; 53/526; 53/439

(58) Field of Classification Search ..... 53/492, 53/381.1, 111 R, 114, 116, 523, 528, 428, 53/430, 436, 439, 389.4, 118, 526; 242/550, 242/566, 552, 324.1
See application file for complete search history.

(56) References Cited

U.S. PATENT DOCUMENTS

| | | | | |
|---|---|---|---|---|
| 2,114,008 | A | 4/1938 | Wunderlich | |
| 2,157,765 | A | 5/1939 | Lanter | |
| 2,295,742 | A | 9/1942 | Lanter | |
| 4,487,377 | A * | 12/1984 | Perini | 242/521 |
| 5,405,100 | A * | 4/1995 | Cooper et al. | 242/564.5 |
| 5,626,001 | A * | 5/1997 | Belec | 53/284.3 |
| 5,730,389 | A * | 3/1998 | Biagiotti | 242/556.1 |
| 6,098,378 | A | 8/2000 | Wyatt | |
| 6,237,870 | B1 * | 5/2001 | Kawamura | 242/533 |
| 6,298,510 | B1 | 10/2001 | Mossbeck | |
| 6,357,209 | B1 | 3/2002 | Mossbeck et al. | |
| 6,810,643 | B1 | 11/2004 | Gecic et al. | |
| 6,866,220 | B2 * | 3/2005 | Sosalla et al. | 242/541.2 |
| 7,117,655 | B2 | 10/2006 | Wells | |
| 7,350,740 | B2 * | 4/2008 | Benvenuti et al. | 242/555.1 |
| 2002/0053188 | A1 | 5/2002 | Mossbeck | |
| 2003/0074863 | A1 | 4/2003 | Mossbeck | |
| 2004/0206051 | A1 | 10/2004 | Gecic et al. | |
| 2005/0224626 | A1 | 10/2005 | Pfeifer | |
| 2006/0175457 | A1 * | 8/2006 | Benvenuti et al. | 242/552 |
| 2007/0181469 | A1 * | 8/2007 | Stover | 209/552 |
| 2010/0146912 | A1 * | 6/2010 | Stover | 53/492 |

OTHER PUBLICATIONS

International Search Report of PCT/US2010/054780 mailed Dec. 30, 2010.

* cited by examiner

*Primary Examiner* — Christopher Harmon
(74) *Attorney, Agent, or Firm* — Shook Hardy & Bacon LLP

(57) ABSTRACT

The present invention is directed to opening a spring roll pack in a controlled manner. A support surface is provided that is positioned to support the spring roll pack. A compression mechanism compresses the spring roll pack. As the spring roll pack is compressed, the spring roll pack is rotated while an accumulator winds wrapping material of the spring roll pack.

12 Claims, 8 Drawing Sheets

SPRING-ROLL-PACK OPENER

BACKGROUND

Springs or coils, such as are used to construct a mattress and other portions of furniture, are often coupled into a sheet of springs, i.e., a spring unit. A method of packaging, shipping, and storing a spring unit includes compressing the spring unit and wrapping the compressed spring unit around a central axis with a length of flexible wrapping material. Usually, several spring units will be compressed and wrapped with the same length of flexible wrapping material into the same spring roll pack. For example, the spring units within a spring roll pack are usually compressed and rolled into the spring roll pack one at a time. A spring roll pack is secured so that it does not unroll while being shipped and stored. For example, the flexible wrapping material is typically secured around the outside of the spring roll pack with tape or another type of temporary adhesive.

Once a spring roll pack has reached its destination, various methods might be used to unroll the spring roll pack. For example, the spring roll pack might be laid on the ground, after which the tape or other temporary adhesive is removed. After the tape or other temporary adhesive is removed, an end of the flexible wrapping material might simply be pulled to initiate an unrolling of the spring roll pack along the ground. Essentially, the roll-packed springs decompress and the spring roll pack unrolls itself in a relatively uncontrolled fashion. While this method effectively dispenses roll-packed spring units, it has various disadvantages. For example, because the spring roll pack is not confined, the relatively sudden decompression and unrolling of the roll-packed spring units present safety hazards. Moreover, the sudden decompression and unrolling often cause spring units, or individual springs, to collide with each other, thereby damaging and/or tangling the springs. Further, once a spring roll pack is opened, all spring units within the spring roll pack must be dispensed and stored loosely (e.g., decompressed and flat) until required in production, thereby inefficiently using storage space.

Another method of unrolling a spring roll pack includes placing the spring roll pack in an enclosed dispensing chamber. The flexible wrapping material is attached to a wind-up system, which pulls and accumulates the flexible wrapping material, thereby having an effect of unrolling the pack and causing spring units to exit from the spring roll pack. While this method addresses some of the safety concerns that are present with an unconfined unrolling approach, spring units are still decompressed rapidly, thereby causing damage to and/or tangling of the springs. As such, to prevent further damage and tangling to the springs and spring units, all spring units are generally unwound to be stored in a loose (i.e., unwrapped) state. All units are also generally unwound as a partially open roll pack is very hard to manipulate. As such, this approach does not resolve issues arising from having to unroll an entire spring roll pack at once and loosely store spring units.

SUMMARY

Embodiments of the invention are defined by the claims below, not this summary. A high-level overview of various aspects of the invention are provided here for that reason, to provide an overview of the disclosure and to introduce a selection of concepts that are further described below in the detailed-description section. This summary is not intended to identify key features or essential features of the claimed subject matter, nor is it intended to be used as an aid in isolation to determine the scope of the claimed subject matter.

The present invention is directed to unrolling a spring roll pack to dispense spring units that are required to satisfy current production needs. As used herein "spring roll pack" generally describes spring units that are compressed and spirally wound around a central axis with a length of flexible material. An exemplary embodiment of the present invention includes a device that unrolls a spring roll pack. The device includes a means for supporting the spring roll pack and a means for compressing the spring roll pack. The device also includes a means for rotating the spring roll pack while the spring roll pack is compressed. The device further includes a means for accumulating the flexible material as it is unwound from the rotating spring roll pack.

Another embodiment of the present invention includes a spring-roll-pack opener having a lower belt that is positioned to support the spring roll pack and an upper belt spaced above the lower belt. A compression mechanism moves the upper belt toward the lower belt, such that when the spring roll pack is loaded onto the lower belt, the upper belt is movable to compress the spring roll pack. Moreover, a wrapping accumulator accepts an end of the flexible material when the spring roll pack is loaded between the lower belt and the upper belt. A drive mechanism is operably coupled to each of the lower belt, the upper belt, and the wrapping accumulator. When the spring roll pack is compressed between the upper belt and the lower belt, the drive mechanism is used to rotate the upper belt and lower belt, thereby unrolling the spring units and the flexible material, which is both secured to and wound by the wrapping accumulator.

Another further embodiment of the present invention is directed to a method of unrolling a spring roll pack. The method includes positioning the spring roll pack onto a first surface and applying continuous pressure both against the spring roll pack and toward the first surface. Moreover, an end of the spring roll pack's flexible material is attached to a wrapping accumulator. The method further includes causing the spring roll pack to rotate while being compressed and gathering the flexible material.

BRIEF DESCRIPTION OF THE SEVERAL VIEWS OF THE DRAWINGS

Embodiments of the present invention are described in detail below with reference to the attached drawing figures, wherein.

DETAILED DESCRIPTION

The subject matter of embodiments of the present invention is described with specificity herein to meet statutory requirements. But the description itself is not intended to necessarily limit the scope of claims. Rather, the claimed subject matter might be embodied in other ways to include different components and/or steps similar to the ones described in this document, in conjunction with other present or future technologies. Terms should not be interpreted as implying any particular order among or between various steps herein disclosed unless and except when the order of individual steps is explicitly described.

Figure 1:
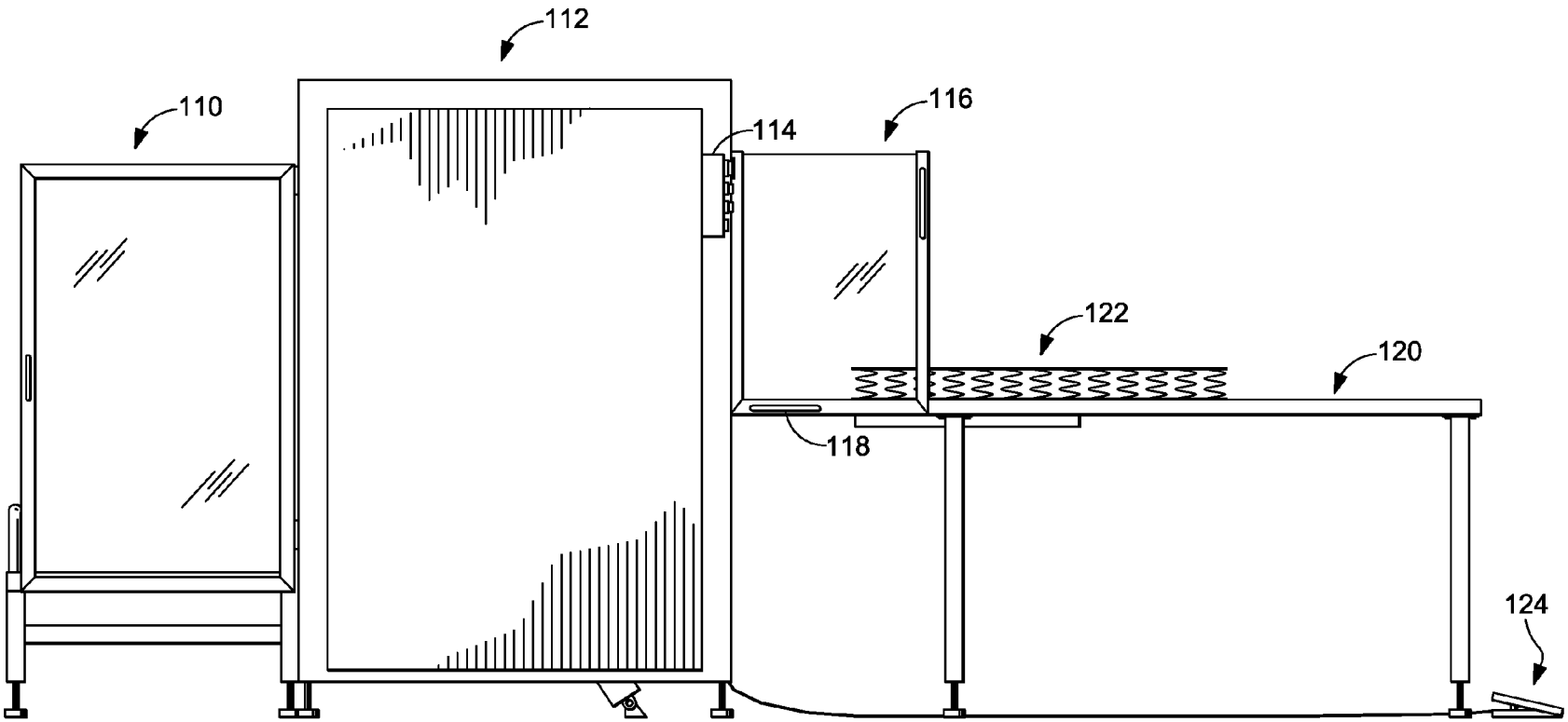
FIG. 1 is a side view of a spring-receiving platform and an outer face of a roll-pack-opener chamber.

An embodiment of the present invention is depicted in FIGS. 1-5. As will be further described in the following paragraphs, FIGS. 1-5 include a means for supporting a spring roll pack, a means for compressing a spring roll pack, a means for rotating the spring roll pack while it is compressed, and a means for accumulating flexible material of the spring roll pack. FIG. 1 illustrates a general side view of a device for unrolling a spring roll pack. FIG. 1 shows a loading-platform side door 110, which opens to provide access to a spring-roll-pack loading/unloading platform (see reference numeral 126 of FIG. 2). Adjacent to the loading-platform door 110 (and loading platform) is a spring-roll-pack opening chamber 112 (or simply "chamber"), which houses other device components (described in more detail below) that are used to unroll a spring roll pack. A proximate control mechanism 114 (e.g., first set of controls for operating a motor of the present invention) controls the other device components. Access gate 116 opens, such that access-gate side 118 is generally vertical, thereby providing access to both proximate control mechanism 114 and device components within the spring-roll-pack opening chamber 112. A receiving platform 120 is positioned adjacent to the spring-roll-pack opening chamber 112 to support a spring unit 122 after the spring unit 122 has been unrolled from a spring roll pack inside the spring-roll-pack opening chamber 112. A distal control mechanism 124 (e.g., second set of controls for operating the motor of the present invention) controls the device components from a position at the distal end of receiving platform 120.

Figure 2B:
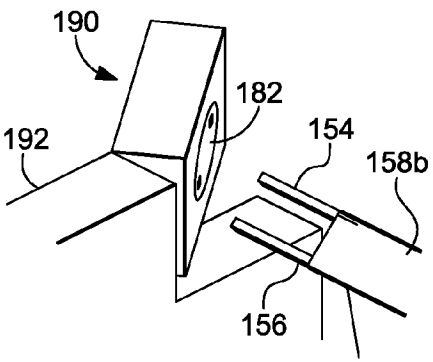
FIG. 2B is an enlarged view of an end of a wrapping accumulator, which is shown in FIG. 2A.
Figure 2A:
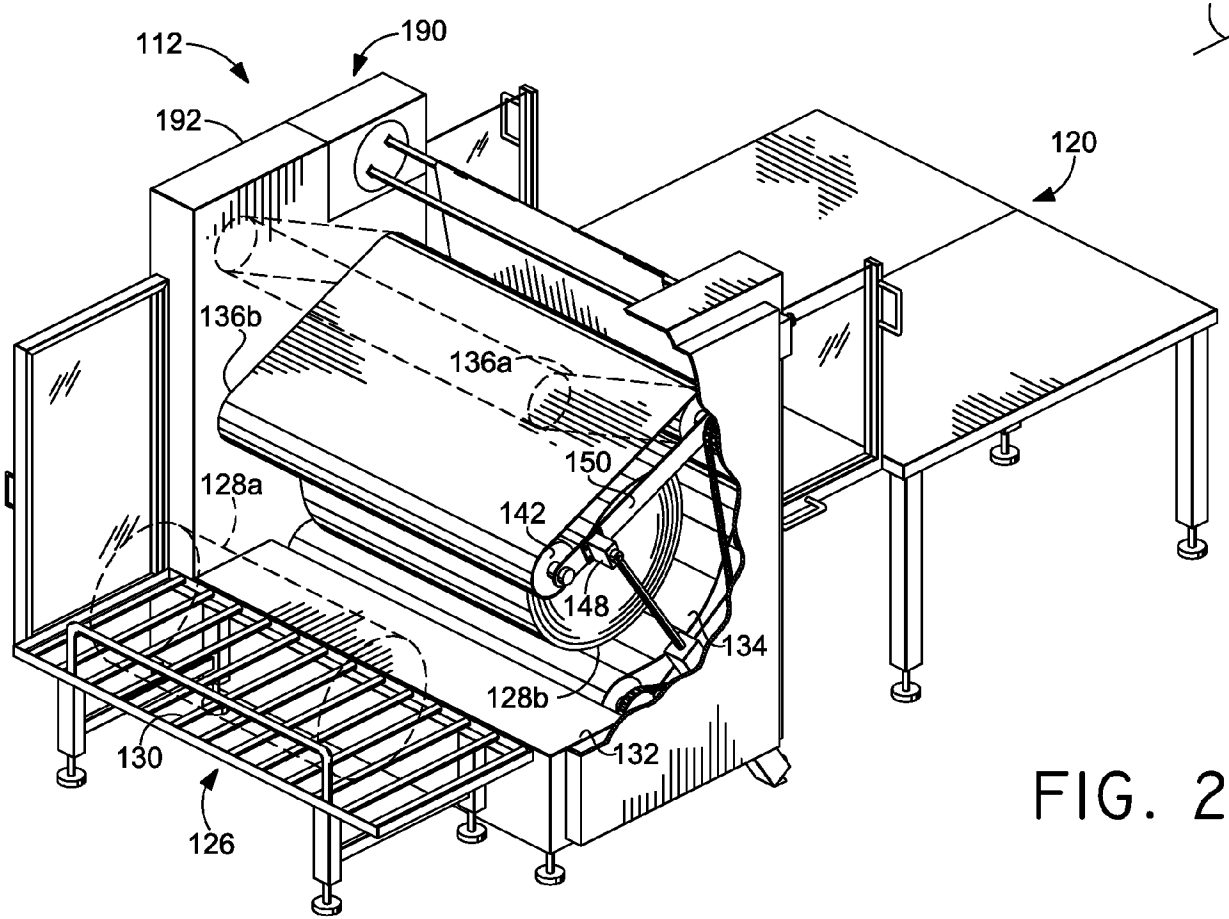
FIG. 2A is a perspective view of a roll-pack opener, in which the roll-pack-opener chamber is shown cut away.

Referring now to FIG. 2A, spring-roll-pack opening chamber 112 is shown with a portion cut away to expose other device components for unrolling a spring roll pack 128*b*. For illustrative purposes, loading-platform side door 110 (shown in FIG. 1) is also not shown in FIG. 2. Loading/unloading platform 126 provides a surface to support a spring roll pack both before the spring roll pack is loaded into the spring-roll-pack opening chamber 112 and after the spring roll pack is unloaded from the spring-roll-pack opening chamber 112. For example, FIG. 2A depicts in a ghost view spring roll pack 128*a*, which represents spring roll pack 128*b* before spring roll pack 128*b* is loaded into the chamber 112. Loading/unloading platform 126 might include individual rollers, such as roller 130, to enable a spring roll pack to be more easily slid across loading/unloading platform 126. In further embodiments a transition platform 132 is provided to assist with moving spring roll pack 128*a* between platform 126 and device components in the chamber 112. While platforms 126 and 132 might be described in some embodiments of the present invention, in other embodiments one or more of platforms 126 and 132 might not be used. For example, device components housed in chamber 112 might be positioned lower to the floor, such that platform 126 is not necessary.

Figure 3:
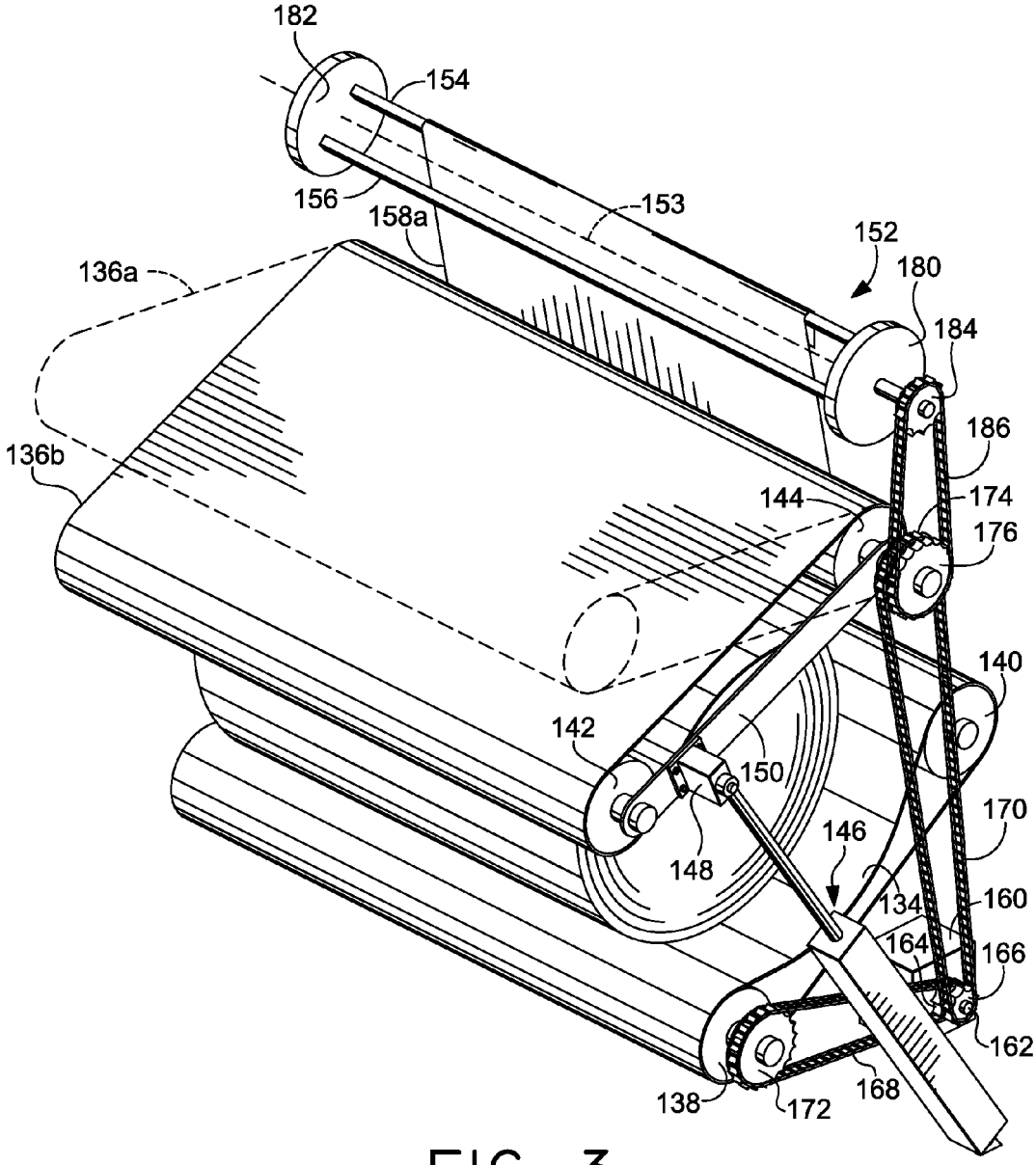
FIG. 3 is a perspective view of a roll-pack opener and shows alternative positions of an upper belt.
Figure 4:
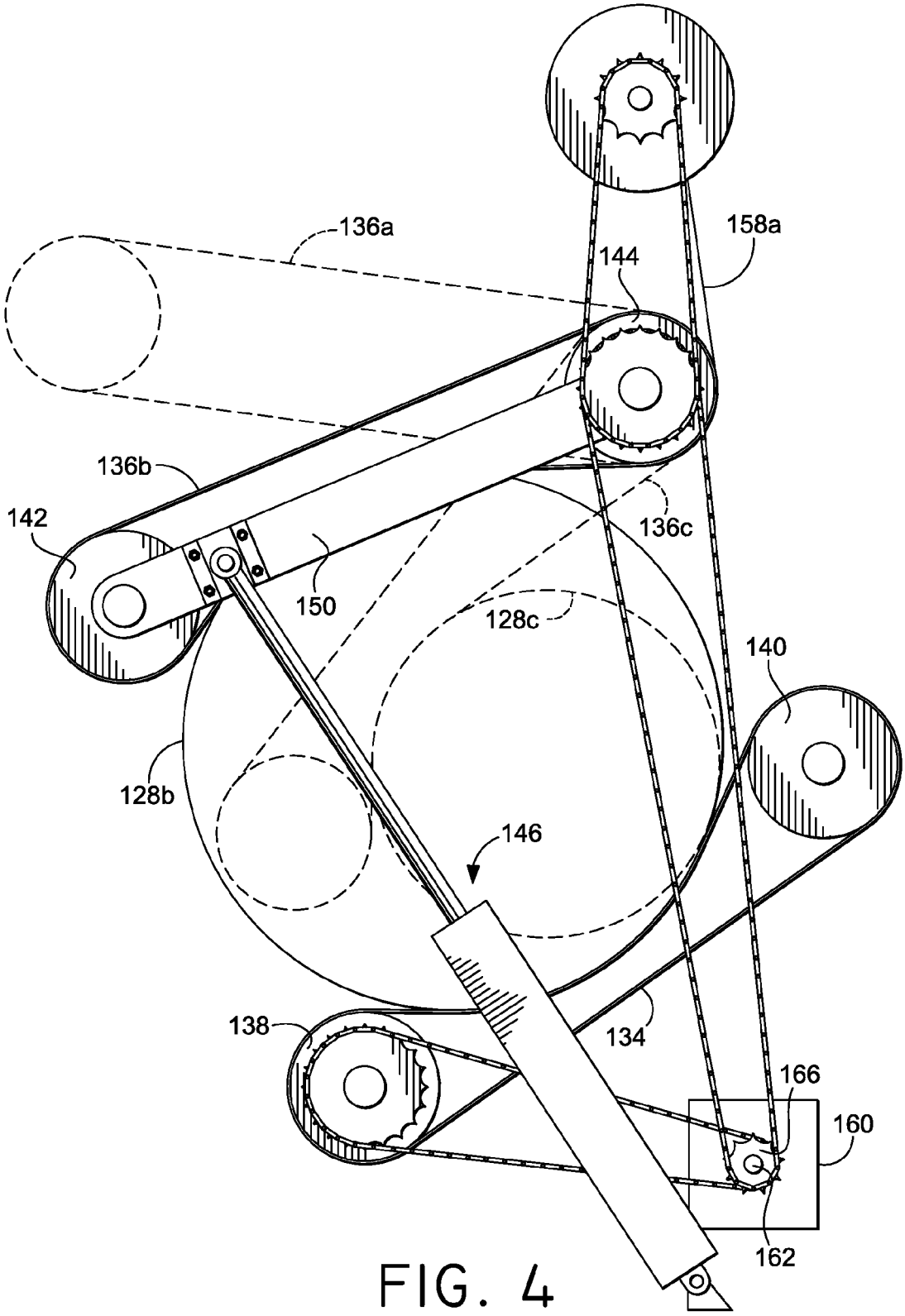
FIG. 4 is a side view of a roll-pack opener and shows alternative positions of an upper belt as a size of a spring roll pack is reduced.
Figure 5:
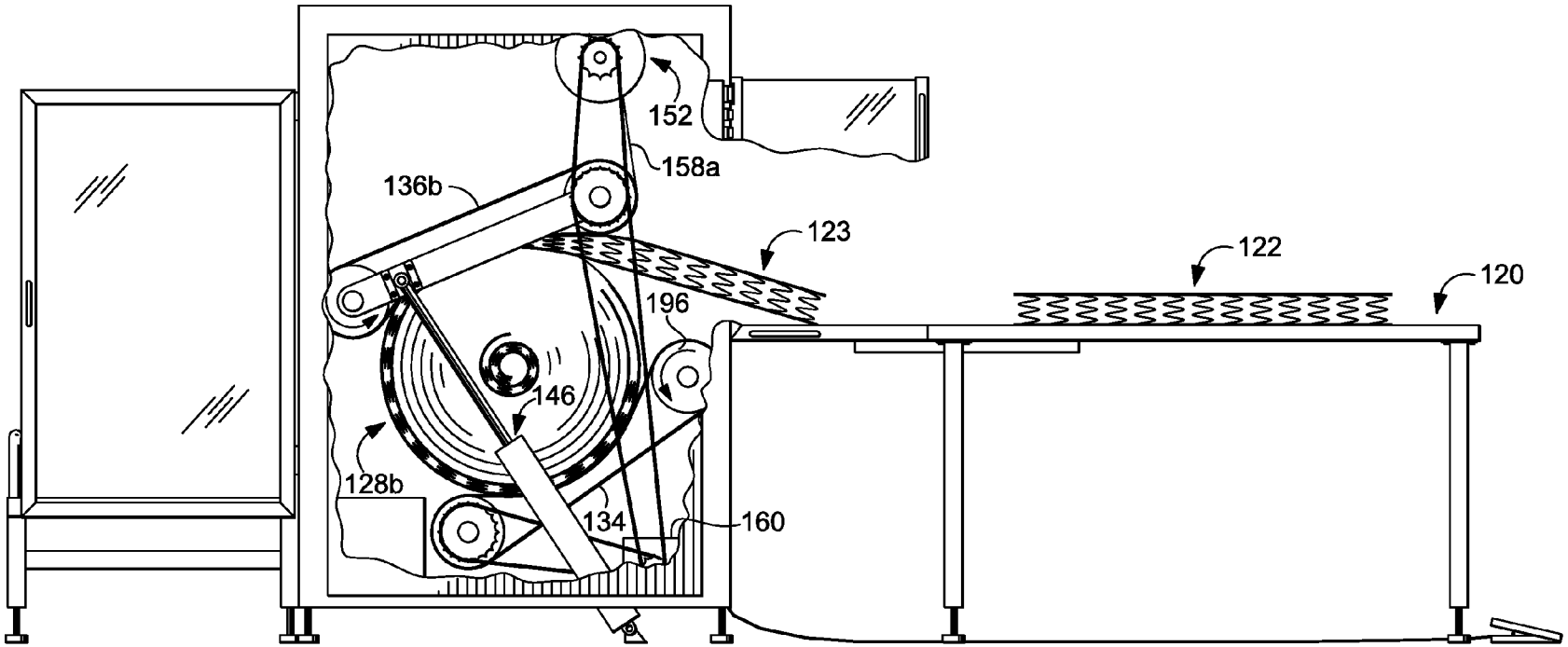
FIG. 5 is a side view of a spring-receiving platform and a roll-pack opener, in which the roll-pack-opener chamber is shown cut away.

Referring now to FIGS. 2A, 2B, 3, and 4, device components, which are used to unroll the spring roll pack 128*b*, will be described in more detail. In an embodiment, device components include a lower belt 134 and an upper belt 136*b*. Lower belt 134 is positioned on a first set of rollers, which includes rollers 138 and 140, and upper belt 136*b* is positioned on a second set of rollers, which includes rollers 142 and 144. The lower belt 134 in combination with rollers 138 and 140 encompass a lower belt assembly and the upper belt 136*b* together with rollers 142 and 144 encompass an upper belt assembly. In one embodiment, each of rollers 138, 140, and 144 rotate (e.g., clockwise and counterclockwise) in a fixed position, and roller 142 is movable by pivoting connection member 150. For example, rollers 138, 140, and 144 might be fixed to a frame inside the chamber 112, and roller 142 is connected to roller 144 by connection member 150. As can be seen in FIGS. 2A, 3, and 4, the upper belt 136*b* is positioned apart from the lower belt 134, such that a space is created between the two belts 134 and 136*b*. A loading end of the space is created between rollers 142 and 138, such that the spring roll pack 128*a* can be loaded into the space from platforms 126 and/or 132. Once a spring roll pack 128*b* is loaded into the space, the lower belt 134 functions as a means to support the spring roll pack 128*b*. A dispensing end of the space is created between rollers 144 and 140, such that an end of the flexible material of spring roll pack 128*b* can extend through the dispensing end. As spring units are dispensed from the spring roll pack 128*b*, the spring units pass through the dispensing end of the space to be received on the receiving platform 120. Although in one embodiment of the invention the means to support the spring roll pack includes a belt, in alternative embodiments, the means to support the spring roll pack includes alternative surfaces that would allow the spring roll pack to rotate about its central axis in a substantially fixed position. For example, instead of including the lower belt, the means to support the spring roll pack might include a lower set of rollers. Likewise, instead of having the upper-belt assembly, the invention might include an upper set of rollers that opposes the lower set of rollers.

In a further embodiment, a compression mechanism moves at least part of the upper belt assembly (i.e., upper belt 136*b* together with rollers 142 and 144) toward lower belt 134. For example, pneumatic cylinder 146 might be used as the compression mechanism. While a pneumatic cylinder is described herein, other types of cylinders might also be utilized, such as a hydraulic cylinder. Pneumatic cylinder 146 is rotatably coupled to a mounting bracket 148 on connection member 150, which extends between rollers 142 and 144. By activating the pneumatic cylinder 146, the connection member 150 pivots relative to roller 144, such that the upper belt 136*b* can be moved both closer to and away from the lower belt 134. Each of FIGS. 2A, 3, and 4 depict the upper belt 136*b* in multiple positions. For example, a raised upper belt 136*a* is shown in ghost view to depict the raised upper belt 136*a* in a position furthest from the lower belt 134. Upper belt 136*b* is shown in a position that is flush with the spring roll pack 128*b*. Moreover, FIG. 4 depicts upper belt 136*c* in a ghost position that is flush with a reduced spring roll pack 128*c* (also shown in ghost view).

Accordingly, spring roll pack 128*a* can be loaded from platforms 126 and 132 onto the lower belt 134. The upper belt can start in a raised position, such as raised upper belt 136*a*, thereby providing sufficient space in the loading end of the space between the upper belt and the lower belt to position the spring roll pack 128*b* onto the lower belt 134. Using the pneumatic cylinder 146, raised upper belt 136*a* is moved toward the lower belt 134, thereby exerting pressure against spring roll pack 128*b*, such as depicted by upper belt 136*b*. As such, pneumatic cylinder 146 combined with upper belt 136*b* function as a means for compressing the spring roll pack 128*b*.

In a further embodiment, each of the upper belt 136*b* and the lower belt 134 is operably coupled to a drive mechanism, which can rotate each of the belts both clockwise and counterclockwise. For example, a drive mechanism might include a motor 160 with an axle 162. A set of sprockets 164 and 166 are coupled to the axle 162. Each sprocket 164 and 166 engages a respective chain 168 and 170. Chain 168 engages another sprocket 172, which is fixed to an end of roller 138. As such, the combination of axle 162, sprocket 164, chain 168, and sprocket 172 transfers the output of motor 160 to roller 138 (i.e., drive roller 138) and the lower belt 134. In a further embodiment, chain 170 engages another sprocket 174, which is fixed to an end of roller 144. Through these components, the output of motor 160 is also transferred to roller 144 (i.e., drive roller 144) and the upper belt 136*b*. As such, when spring roll pack 128*b* is loaded between the upper belt 136*b* and the lower belt 134, and the compression mechanism (e.g., pneumatic cylinder 146) is used to compress the spring roll pack between the belts 136*b* and 134, spring roll pack 128*b* can be caused to rotate in a near fixed position by rotating both belts 134 and 136*b* in a same direction using the drive mechanism (e.g., motor 160 with axle 162). As such, the drive mechanism and other components that transfer the output of the drive mechanism to both the lower belt assembly and the upper belt assembly function as a means for rotating the spring roll pack.

In a further embodiment, the present invention includes a wrapping accumulator 152. The wrapping accumulator 152 includes two elongated members 154 and 156, which are positioned near parallel to each other. End caps 180 and 182 are positioned at the ends of the elongated members 154 and 156. The end caps 180 and 182 function to secure the elongated members 154 and 156 in a fixed position, such that when the elongated members 154 and 156 are rotated, the elongated members serve as a spool to wind the flexible material 158*a*. In one embodiment each end cap 180 and 182 includes a respective pair of holes that are shaped and sized to receive ends of the elongated members 154 and 156. End cap 180 is coupled to wrapping-accumulator sprocket 184, which engages chain 186. Chain 186 also engages sprocket 176, which is coupled at the end of roller 144 together with sprocket 174. As such, when the output of the drive mechanism is transferred to drive roller 144 (as previously described), the output also rotates sprocket 176. In turn, sprocket 176 engages chain 186 and rotates the wrapping-accumulator sprocket 184, thereby transferring the output of the drive mechanism to cap 180 and the wrapping accumulator 152. In one embodiment, the wrapping accumulator 152 rotates about axis 153, which is shown as a dashed line in FIG. 3. In one embodiment, sprocket 184 is sized smaller than sprockets 172 and 174 to enable the wrapping accumulator 152 to rotate slightly faster than the lower belt 134 and the upper belt 136*b*, thereby generating a slight pull on the flexible material 158*a*. In a further embodiment, cap 182 is rotatably fixed to door 190, such that when the door 190 is closed (i.e., positioned in the same plane as side 192 of chamber 112), cap 182 secures elongated members 154 and 156 and rotates together with the elongated members 154 and 156 when they are turned by cap 180. When door 190 is opened (as shown in FIG. 2B) cap 182 disengages from the elongated members 154 and 156 to enable flexible material 158*b* that is wrapped around elongated members 154 and 156 to be slid off the end of the elongated members 154 and 156.

In an exemplary embodiment, the wrapping accumulator 152 receives an end of the flexible material 158*a* of the spring roll pack. For example, as previously described, after spring units are compressed and wound into a spring roll pack, an end of the flexible material is secured with tape to the outer layer of the spring roll pack to prevent the spring roll pack from unwinding. Accordingly, to couple an end of the flexible material to the wrapping accumulator 152, the tape (or other temporary adhesive) is removed and the end that was secured to the spring roll pack is coupled to the wrapping accumulator 152. In one embodiment, to attach the flexible material 158*a* to the wrapping accumulator 152, an end of the flexible material 158*a* is passed between the elongated members 154 and 156 and folded over one of the elongated members. For example, FIG. 3 shows that the flexible wrapping material 158*a* is folded over elongated member 154. Once folded over an elongated member, the end of the flexible material 158*a* might be affixed back onto a more inner portion of the flexible material 158*a* to more securely attach the flexible material 158*a* to the elongated member.

When the two elongated members 154 and 156 are caused to rotate about one another, the flexible material 158*a* is wrapped around the elongated members 154 and 156. For example, the flexible material 158*a* might be wrapped when the spring roll pack 128*b* is compressed between the belts 134 and 136*b* and the flexible material 158*a* is unwound from the spring roll pack 128*b*. Once a desired number of spring units have been dispensed from the spring roll pack 128*b*, the drive mechanism can be stopped while the spring roll pack 128*b* continues to be compressed between the belts 134 and 136*b*. The flexible material 158*a* that is exposed between the spring roll pack and the wrapping accumulator can be cut, thereby enabling the portion of the flexible material that has been wound around elongated members 154 and 156 (e.g., portion 158*b* of FIG. 2B) to be slid off the ends thereof. The portion of the flexible material that is still wound in the compressed spring roll pack can be secured to an outer layer of the spring roll pack. For example, the drive mechanism might be engaged in the opposite direction (i.e., opposite to the direction in which spring units were dispensed) while tape is fed onto the spring roll pack. Because a spring roll pack is continuously compressed while individual spring units are dispensed, the spring units that are not dispensed remain compressed, undamaged, and untangled within the spring roll pack.

A further embodiment of the present invention includes a method of unrolling a spring roll pack, which includes spring units that are compressed and spirally wound in a first direction around a central axis with a length of flexible material. For example, referring to FIG. 5, spring roll pack 128*b* includes spring units that are wound clockwise. The spring roll pack 128*b* is positioned onto a first surface, which moves in a second direction that is opposite to the first direction. For example, spring roll pack 128*b* is positioned onto lower belt 134, which moves counterclockwise, as depicted by arrow 196. Continuous pressure is applied both against the spring roll pack 128*b* and toward the first surface, thereby compressing the roll-packed springs toward the central axis. For example, pneumatic cylinder 146 is used to move upper belt 136*b* toward lower belt 134, thereby applying continuous pressure against spring roll pack 128*b*. An end of the flexible material is attached to a wrapping accumulator. For example, flexible material 158*a* is coupled to wrapping accumulator 152 (as previously described). The spring roll pack is caused to rotate in the first direction while the continuous pressure compresses the spring roll pack toward the central axis and the flexible material is gathered by the wrapping accumulator, thereby unwrapping the spring units. For example, motor 160 is used to rotate the upper belt and the lower belt in a counterclockwise direction, thereby rotating the spring roll pack 128*b* in a clockwise direction. Motor 160 is also used to rotate the wrapping accumulator 152, thereby winding flexible material 158*a* as it is unwound from the spring roll pack 128*b*. As the spring roll pack 128*b* is rotated clockwise and the flexible material 158*a* is wound onto wrapping accumulator 152, spring units (e.g., 122 and 123) are dispensed onto receiving platform 120.

In a further embodiment, a method of unrolling spring units from a spring roll pack includes only dispensing spring units that are currently needed for production. As such, once a desired number of spring units have been dispensed the rotation of the spring roll pack is stopped, such that a portion of the plurality of spring units remain compressed and spirally wound. For example, if spring unit 123 (of FIG. 5) is not needed for current production, rotation of spring roll pack 128*b* might be stopped after spring unit 122 has been dispensed. A next step includes rotating the spring roll pack in the second direction while the continuous pressure compresses the spring roll pack, thereby wrapping the portion of the plurality of spring units. For example, the output of motor 160 might be reversed to cause lower belt and upper belt to turn clockwise, thereby causing the spring roll pack 128*b* to rotate counterclockwise (i.e., opposite to the dispensing direction) and to reroll spring unit 123. A further step includes securing the flexible material to an outside portion of the flexible material that is used to wrap the portion of the plurality of spring units. For example, once spring unit 123 is rolled into spring roll pack 128*b*, flexible material 158*a* is cut to remove a portion of the flexible material that is wound around wrapping accumulator 152. The edge of flexible material 158*a* is attached to the outside of spring roll pack 128*b*. A next step includes decreasing the continuous pressure that is applied both against the portion of the plurality of spring roll pack 128*b* and toward the first surface. For example, using pneumatic cylinder 146, the upper belt 136*b* is moved to a raised position. Finally the spring roll pack 128*b* can be removed from the lower belt 134.

Figure 6:
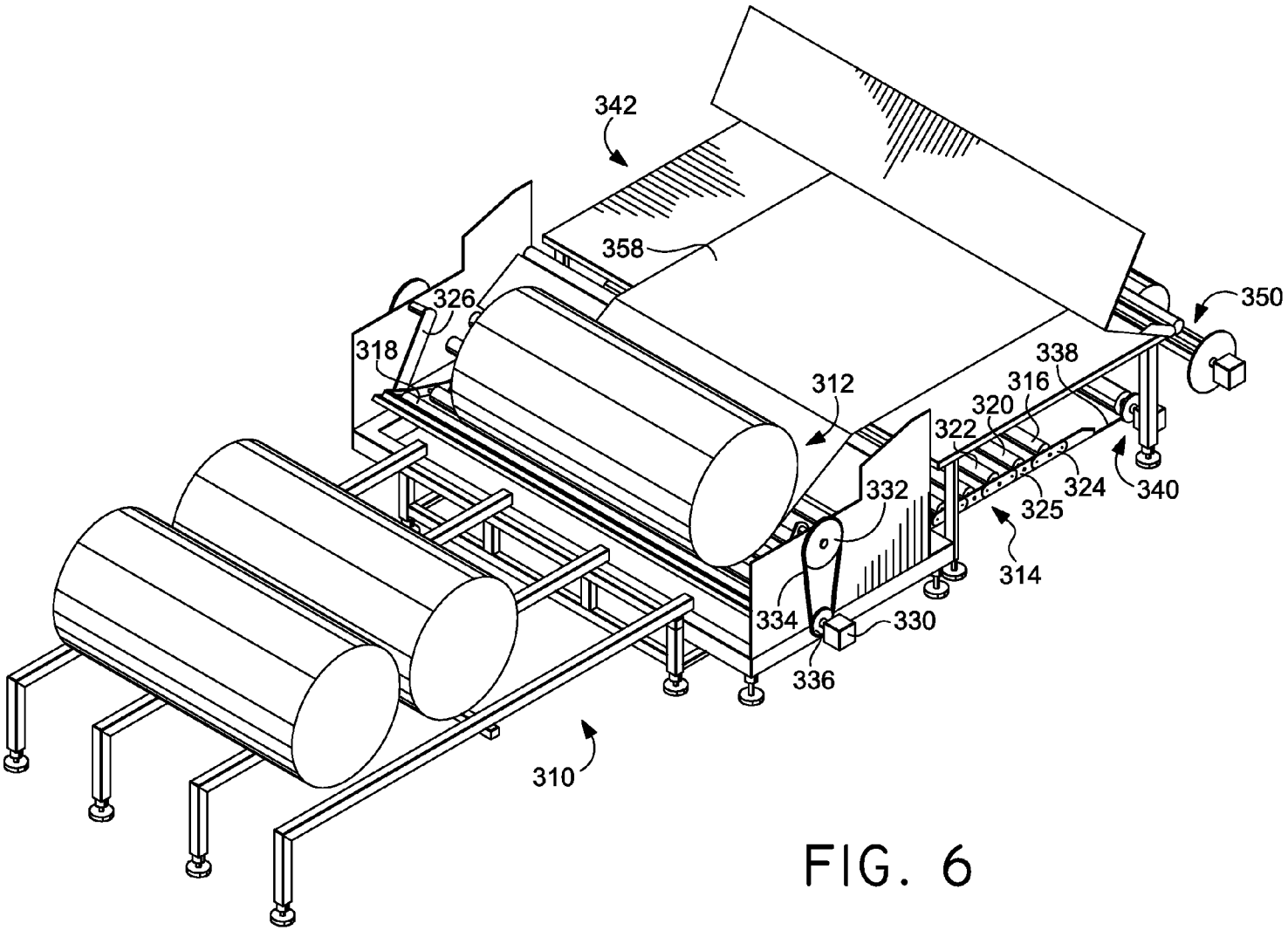
FIG. 6 is a perspective view of an alternative embodiment of a roll-pack opener and shows that a spring roll pack has been loaded onto a sheet of rollers.
Figure 7:
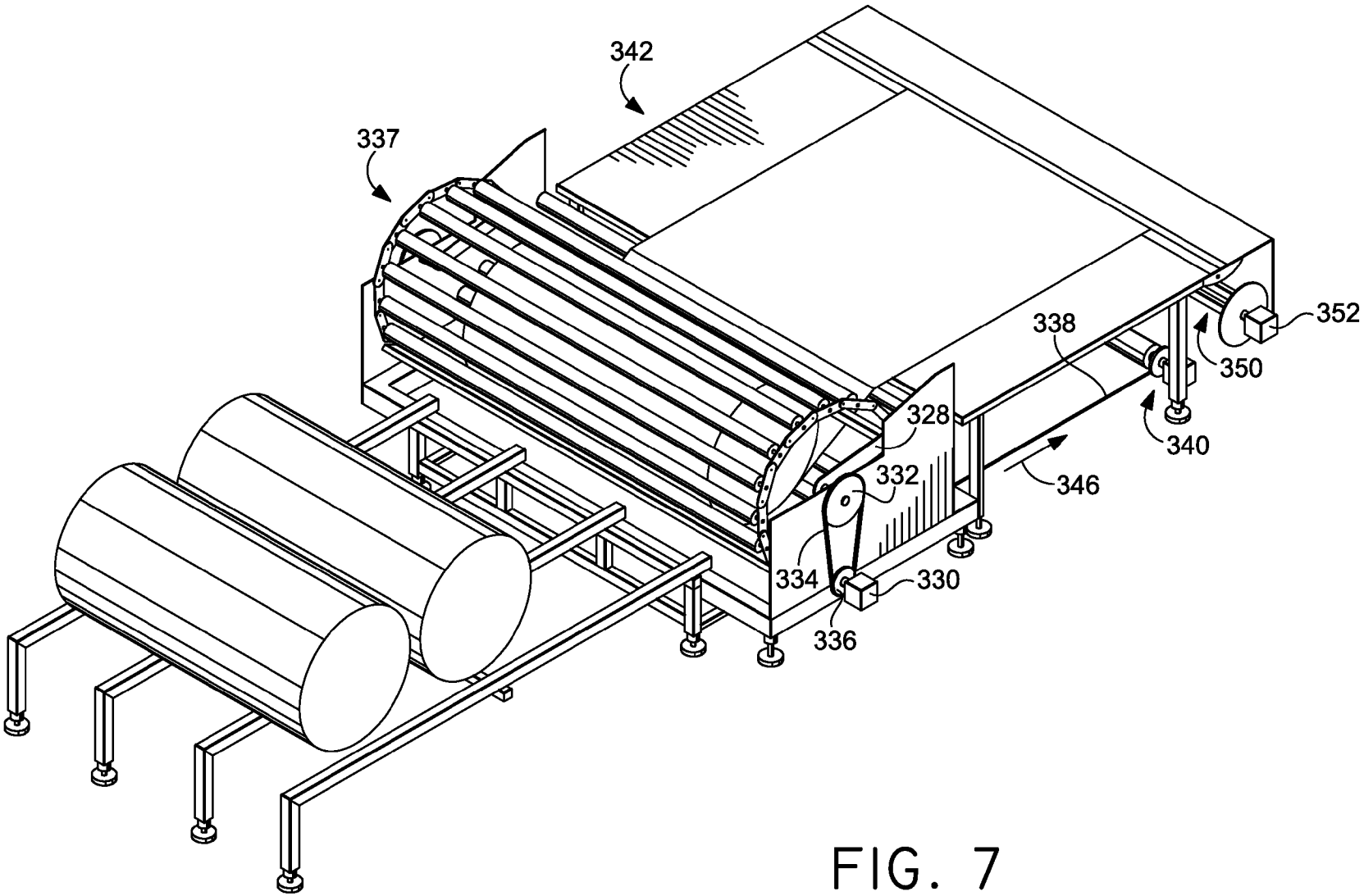
FIG. 7 is a view similar to FIG. 6 and shows that the sheet of rollers have been positioned to partially surround the spring roll pack.
Figure 8:
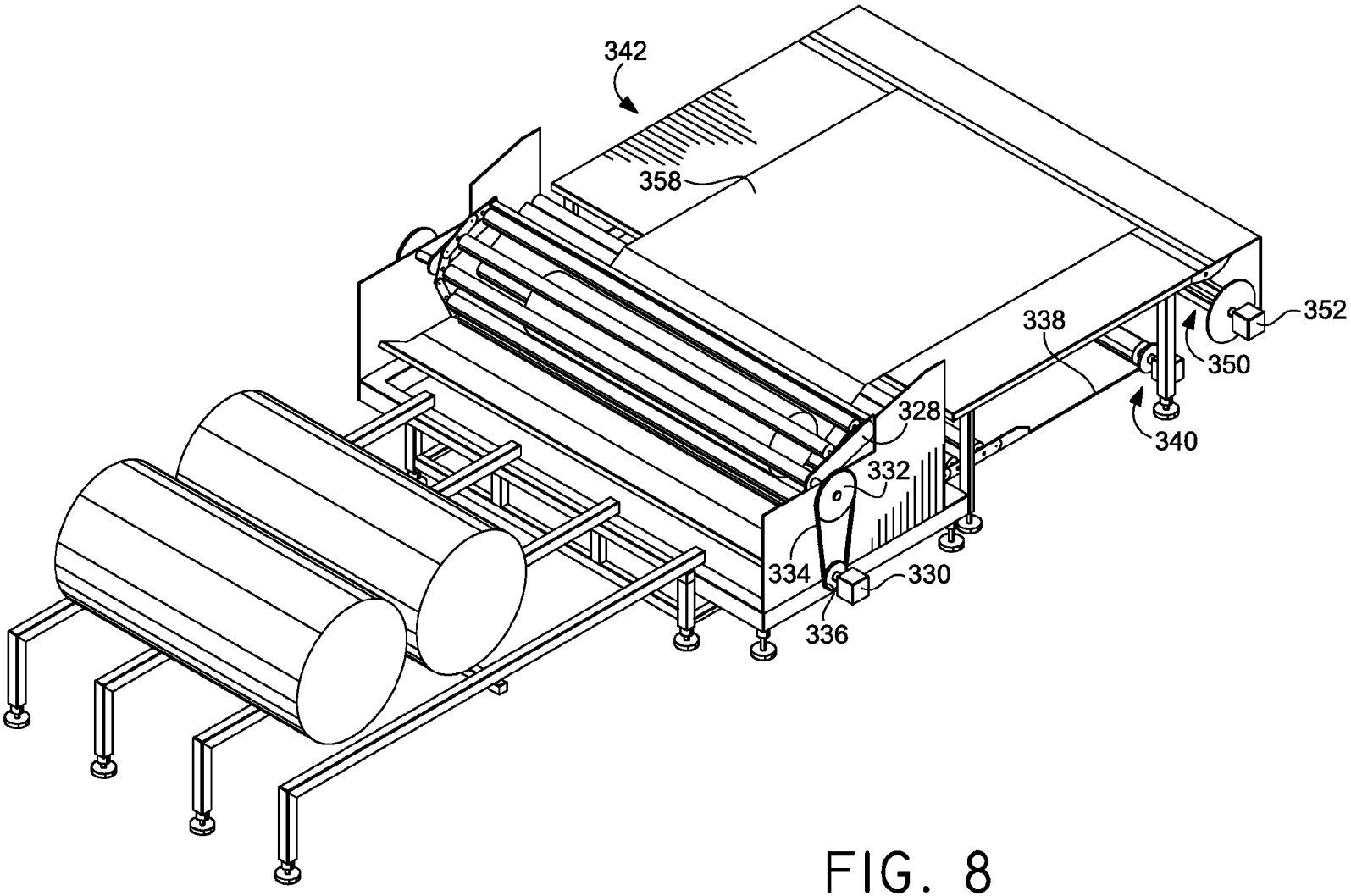
FIG. 8 is a view that is similar to FIGS. 6 and 7 and shows a partially unrolled spring roll pack, which is compressed between rollers of the sheet of rollers.

Another embodiment of the present invention is shown in FIGS. 6-8. FIGS. 6-8 include a means for supporting a spring roll pack, a means for compressing a spring roll pack, a means for rotating the spring roll pack while it is compressed, and a means for accumulating flexible material of the spring roll pack. A loading/unloading platform 310 is arranged adjacent to other device components that are usable to unroll a spring roll pack, such as spring roll pack 312. A further embodiment of the present invention includes a sheet of rollers 314, which includes two end rollers 316 and 318, and a set of rollers (e.g., rollers 320 and 322) that are arranged both between and substantially parallel with end rollers 316 and 318. Although some of the rollers are partially hidden in FIGS. 6-8, in an exemplary embodiment rollers are evenly spaced between end rollers 316 and 318. For example, rollers are positioned beneath spring roll pack 312 to support the spring roll pack 312. The end rollers 316 and 318 and the plurality of rollers are each coupled to one or more adjacently positioned rollers of the sheet of rollers 314. For example, pivotable links 324 and 325 couple end roller 316 to roller 320. Roller 320 is coupled to both of end roller 316 and roller 322. Although not shown in the figures, a similar link is coupled at the opposite end of rollers 316 and 320. As such, in an embodiment, the sheet of rollers 314 function as a means for supporting the spring roll pack 312.

In a further embodiment, near end roller 318 the sheet of rollers 314 is coupled to a pair of rotatable arms 326 and 328. Rotatable arms 326 and 328 are operably coupled to sprocket 332, which engages chain 334. Chain 334 engages a sprocket 336, which is coupled to an axle of a drive mechanism, e.g., motor 330. Through sprocket 336, chain 334, and sprocket 332, the output of motor 330 is transferred to arms 326 and 328 to pivot the rotatable arms 326 and 328 from a first position (depicted in FIG. 6) to a second position (depicted in FIGS. 7 and 8). When the arms 326 and 328 are in a first position, the sheet of roller is relatively flat. However, when the arms are rotated to the second position, a first portion 337 of the sheet of rollers (near end roller 318) is moved to a position that opposes a second portion of the sheet of rollers, such that the sheet of rollers 314 form a curved arrangement. When spring roll pack 312 is loaded onto the sheet of rollers 314, the sheet of rollers 314 are movable into the curved arrangement, such that the first portion 337 is positionable on top of the spring roll pack 312.

In a further embodiment, the sheet of rollers 314 are coupled near end roller 316 to a tensioning mechanism 340. For example, cable 338 couples the sheet of rollers 314 to tensioning mechanism 340, which might include a motor or a tensioning spring. When arms 326 and 328 rotate to a second position, thereby positioning the first portion 337 of the sheet of rollers to oppose another portion of the sheet of rollers, the tensioning mechanism 340 maintains tension in the sheet of rollers by pulling on the sheet of rollers near end roller 316 in the direction of arrow 346. When spring roll pack 312 is positioned between the first portion 337 and the rest of the sheet of rollers 314, and tension is maintained in the direction of arrow 346, spring roll pack 312 is compressed between the first portion 337 of the sheet of rollers 314 and a portion of the sheet of rollers 314 that opposes the first portion 337. As such, the sheet of rollers 314 in combination with the tensioning mechanism 340 function as a means for compressing the spring roll pack 312.

A receiving platform 342 is positioned to support a spring unit after the spring unit has been dispensed from the spring roll pack 312. A wrapping accumulator 350 is positioned at the end of the receiving platform 342. Similar to the wrapping accumulator 152, the wrapping accumulator 350 includes two elongated members positioned between two end caps. Drive mechanism 352 is operable to rotate the elongated members of wrapping accumulator 350, thereby winding flexible material 358 that is secured to the elongated members. As the flexible material is pulled by the wrapping accumulator 350, the spring roll pack 312 is caused to rotate while being compressed by the sheet of rollers 314. As such, the wrapping accumulator functions as both a means for rotating the sheet of rollers and a means for accumulating the flexible material.

A further embodiment of the present invention includes a method of unrolling a spring roll pack, which includes spring units that are compressed and spirally wound in a first direction around a central axis with a length of flexible material. The spring roll pack is positioned onto a first surface, which moves in a second direction that is opposite to the first direction. For example, spring roll pack 312 (wound counterclockwise) is positioned onto sheet of rollers 314, which includes rollers (e.g., roller 322) that can rotate either clockwise or counterclockwise. In a next step, continuous pressure is applied both against the spring roll pack and toward the first surface, thereby compressing the roll-packed springs toward the central axis. For example, the sheet of rollers 314 is moved using arms 326 and 328 into a curved arrangement, such that a portion 337 of the sheet of rollers is positioned on top of the spring roll pack 312. By pulling on cable 338 with tensioning mechanism 340, portion 337 of the sheet of rollers 314 applies continuous pressure against the spring roll pack 312. In a following step, an end of the flexible material is attached to a wrapping accumulator. For example, an end of flexible material 358 is attached to wrapping accumulator 350. In a further step, the spring roll pack is caused to rotate in the first direction while the continuous pressure compresses the roll-packed springs toward the central axis and the flexible material is gathered by the wrapping accumulator, thereby unwrapping the spring units. For example, wrapping accumulator 350 is rotated, thereby pulling on flexible material 358 and causing the spring roll pack 312 to rotate counter-clockwise while being compressed by the sheet of rollers 314.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A device that unrolls a spring roll pack, which includes spring units that are compressed and spirally wound in a first direction around a central axis with a length of flexible material, the device comprising:

a lower belt that rotates in a second direction about a first set of rollers and that is positioned to support the spring roll pack, such that the central axis is generally parallel to each roller of the first set of rollers;

an upper belt spaced above the lower belt to define a space between the upper belt and the lower belt, wherein the upper belt rotates in the second direction about a second set of rollers;

a compression mechanism that moves the upper belt toward the lower belt, such that when the spring roll pack is loaded through a loading end of the space and onto the lower belt, the upper belt is movable to compress the spring roll pack toward the central axis;

a wrapping accumulator that rotates about an axis and that accepts an end of the flexible material when the spring roll pack is loaded into the space and onto the lower belt, wherein the axis of the wrapping accumulator is positioned generally parallel to both the first set of rollers and the second set of rollers; and a drive mechanism having an axle that is operably coupled to each of the first set of rollers, the second set of rollers, and the wrapping accumulator, (1) wherein a rotation of the axle rotates the lower belt and the upper belt in the second direction, (2) wherein the rotation of the axle rotates the wrapping accumulator about the axis in one of the first direction and the second direction, and (3) wherein when the spring roll pack is compressed between the upper belt and the lower belt, the upper belt and lower belt are operable to rotate the spring roll pack in the first direction, thereby unrolling the spring units and the flexible material, which is both secured to and wound by the wrapping accumulator.

2. The device of claim 1, wherein one roller of the second set of rollers is a fixed roller, which rotates in a fixed position; and wherein the upper belt is movable toward the lower belt when the second set of rollers pivots on the fixed roller.

3. The device of claim 2, wherein the compression mechanism includes a pneumatic cylinder operably coupled to the second set of rollers, and wherein the pneumatic cylinder is usable to pivot the second set of rollers on the fixed roller.

4. The device of claim 1, wherein a first chain couples the axle of the motor to a first drive roller of the first set of rollers;

wherein a second chain couples the axle of the motor to a second drive roller of the second set of rollers; and wherein a third chain couples the second drive roller of the second set of rollers to the wrapping accumulator, such that rotation of the second drive roller also rotates the wrapping accumulator.

5. The device of claim 4, wherein the second chain and the third chain engage one or more sprockets, which are coupled to the second driver roller;

wherein the third chain engages both the one or more sprockets and a wrapping-accumulator sprocket, which has a smaller diameter than the one or more sprockets; and wherein the smaller diameter of the wrapping-accumulator sprocket enables the wrapping accumulator to rotate at a faster speed than the second drive roller.

6. The device of claim 1 further comprising a receiving platform positioned adjacent to a distribution end of the space, wherein the distribution end of the space opposes the loading end of the space, and wherein the receiving platform is usable to support a spring unit that is unrolled from the spring roll pack.

7. The device of claim 6 further comprising a plurality of motor controls, wherein a first set of motor controls is positioned in close proximity to the space, such that both the first set of motor controls and the wrapping accumulator are accessible from a same operating position of an operator, and wherein a second set of motor controls is positioned at an end of the receiving platform that is distal relative to the space, such that the both the second set of motor controls and the spring unit that is unrolled are accessible from an alternate same operating position.

8. The device of claim 7, wherein the plurality of motor controls enable movement of the axle of the motor in both the first direction and the second direction, wherein movement of the axle of the motor in the second direction unrolls a rolled spring unit from the spring roll pack that is compressed between the lower belt and the upper belt, and wherein movement of the axle of the motor in the first direction rolls an unrolled spring unit into the spring roll pack.

9. A device that unrolls a spring roll pack, which includes spring units that are compressed and spirally wound in a first direction around a central axis with a length of flexible material, the device comprising:

a means for supporting the spring roll pack, wherein the means for supporting moves in a second direction that is opposite to the first direction;

a means for compressing the spring roll pack toward the central axis when the spring roll pack is supported by the means for supporting;

a means for rotating the spring roll pack in the first direction when the spring roll pack is compressed toward the central axis; and a means for accumulating the flexible material as it is unwound from the spring roll pack when the spring roll pack is compressed toward the central axis and rotated in the first direction.

10. The device of claim 9, wherein both the means for supporting and the means for compressing comprise a sheet of rollers, which is positionable in a flat arrangement that is usable to support the spring roll pack, wherein the sheet of rollers comprises two end rollers and a plurality of rollers that are positioned both parallel to and between the end rollers;

wherein the end rollers and the plurality of rollers are each coupled to one or more adjacently positioned rollers of the sheet of rollers;

wherein the sheet of rollers is positionable in a curved arrangement in which a first portion of the sheet of rollers is movable to a position above a second portion of the sheet of rollers, thereby defining a space between the first portion and the second portion;

wherein in the curved arrangement, the spring roll pack is positionable in the space and between the first portion and the second portion; and wherein in the curved arrangement, by pulling on one of the end rollers, which is at the end of the second portion, the first portion contracts toward the second portion, thereby compressing the spring roll pack when the spring roll pack is in the space.

11. The device of claim 10, wherein both the means for rotating and the means for accumulating comprise one or more elongated members that are rotatable and that receive an end of the flexible material of the spring roll pack;

wherein the one or more rotating elongated members are positioned near parallel to the central axis of the spring roll pack; and wherein, when the spring roll pack is compressed between the first portion of the sheet of rollers and the second portion of the sheet of rollers and when the end of the flexible material is attached to the elongated members, rotation of the elongated members winds the flexible material, thereby rotating the spring roll pack in the first direction and unwrapping the spring units from the spring roll pack.

12. The device of claim 9, wherein the means for supporting comprises a lower belt that rotates in a second direction about a first set of rollers and that is positioned to support the spring roll pack, such that the central axis is generally parallel to each roller of the first set of rollers;

wherein the means for compressing comprises both an upper belt spaced above the lower belt to define a space therebetween and a compression mechanism that moves the upper belt toward the lower belt, such that when the spring roll pack is loaded through a loading end of the space and onto the lower belt, the upper belt is movable to compress the spring roll pack toward the central axis;

wherein the means for wrapping comprises one or more elongated members that rotate about an axis and that accepts an end of the flexible material when the spring roll pack is loaded into the space and onto the lower belt, wherein the axis of the one or more elongated members is positioned generally parallel to both the first set of rollers and the second set of rollers; and wherein the means for rotating comprises a drive mechanism having an axle that is operably coupled to each of the first set of rollers, the second set of rollers, and the one or more elongated members, (1) wherein a rotation of the axle rotates the lower belt and the upper belt in the second direction, (2) wherein the rotation of the axle rotates the one or more elongated members about the axis in one of the first direction and the second direction, and (3) wherein when the spring roll pack is compressed between the upper belt and the lower belt, the upper belt and lower belt are operable to rotate the spring roll pack in the first direction, thereby unrolling the spring units and the flexible material, which is both secured to and wound by the one or more elongated members.

* * * * *